US009494398B2

(12) United States Patent
Czebiniak

(10) Patent No.: US 9,494,398 B2
(45) Date of Patent: Nov. 15, 2016

(54) PRIMER POCKET SWAGER

(71) Applicant: Mark Czebiniak, Glendale, AZ (US)

(72) Inventor: Mark Czebiniak, Glendale, AZ (US)

( * ) Notice: Subject to any disclaimer, the term of this patent is extended or adjusted under 35 U.S.C. 154(b) by 0 days.

(21) Appl. No.: 15/081,594

(22) Filed: Mar. 25, 2016

(65) Prior Publication Data

US 2016/0216093 A1 Jul. 28, 2016

Related U.S. Application Data

(60) Provisional application No. 62/288,533, filed on Jan. 29, 2016.

(51) Int. Cl.
*F42B 33/10* (2006.01)

(52) U.S. Cl.
CPC ..... *F42B 33/10* (2013.01)

(58) Field of Classification Search
CPC ..... F42B 33/04; F42B 33/10; F42B 35/02; B21K 21/12; B21K 21/14; B23P 15/22
USPC ..... 86/24, 28, 33, 37, 40, 1.1; 72/370.13
See application file for complete search history.

(56) References Cited

U.S. PATENT DOCUMENTS 3,138,055 A * 6/1964 Weston ..... F42B 33/04 86/36
3,408,892 A * 11/1968 Smith ..... F42B 33/04 221/190
4,142,441 A * 3/1979 Schaenzer ..... F42B 33/04 86/24
4,163,410 A * 8/1979 Dillon ..... F42B 33/004 86/23
4,620,472 A * 11/1986 Dillon ..... F42B 33/04 86/25
4,723,472 A * 2/1988 Lee ..... F42B 33/10 86/23
4,732,073 A * 3/1988 Semon ..... F42B 33/04 15/104.2
4,887,509 A * 12/1989 Hodulik ..... F42B 33/04 29/254
6,397,718 B2 * 6/2002 Jamison ..... B21D 51/54 86/19.7
2007/0022870 A1 * 2/2007 Bond ..... F42B 33/001 86/24

* cited by examiner

*Primary Examiner* — Bret Hayes

(74) *Attorney, Agent, or Firm* — Schmeiser, Olsen & Watts LLP

(57) ABSTRACT

A primer pocket swager is provided. The primer pocket swager includes a base removably coupled to a press. It further includes a swage pin removably coupled to the base, wherein the base includes a first support surface and a second support surface, wherein the first support surface contacts a first corresponding surface of the press and the second support surface contracts a second corresponding surface of the press. The first support surface is located on a different and substantially parallel plane than the second support surface.

15 Claims, 7 Drawing Sheets

PRIMER POCKET SWAGER

CROSS REFERENCE TO RELATED APPLICATION[S]

This application claims priority to U.S. Provisional Patent Application entitled "PRIMER POCKET SWAGER," Ser. No. 62/288,533, filed Jan. 29, 2016, the disclosure of which is hereby incorporated entirely herein by reference.

BACKGROUND OF THE INVENTION

Technical Field

This invention relates generally to a swager and more particularly to a primer pocket swager.

State of the Art

Military and some retail brass casings for ammunition include crimped primer pockets. This makes reloading the brass casings difficult or impossible. In order to do so, the brass must be swaged in order to re-size the primer pocket, remove the crimp and reload the military brass. One machine that is utilized in reloading of ammunition is Dillon XL650 press. There does not exist a frame mounted swaging system for use with a Dillon XL650.

Accordingly, there is a need in the field of swagers for an improved primer pocket swager.

SUMMARY OF THE INVENTION

The present invention relates to a primer pocket swager that is frame mounted to a press, such as a Dillon XL650 press.

Embodiments of the present invention include a primer pocket swager comprising a base removably coupled to a press; a swage pin removably coupled to the base, wherein the base comprises a first support surface and a second support surface, wherein the first support surface contacts a first corresponding surface of the frame of the press and the second support surface contracts a second corresponding surface of the frame of the press. The first support surface is located on a different and substantially parallel plane than the second support surface.

Another embodiment of the present invention includes a method of using a primer pocket swager. The method may generally include mounting a primer pocket swager to a reloading press; placing a shell case onto a shell plate of the reloading press; operating the reloading press; and reforming a primer pocket of the shell case in response to operating the reloading press.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

As discussed above, embodiments of the present invention relate to a primer pocket swager that is frame mounted to a reloading press, such as a Dillon XL650 press.

Figure 1:
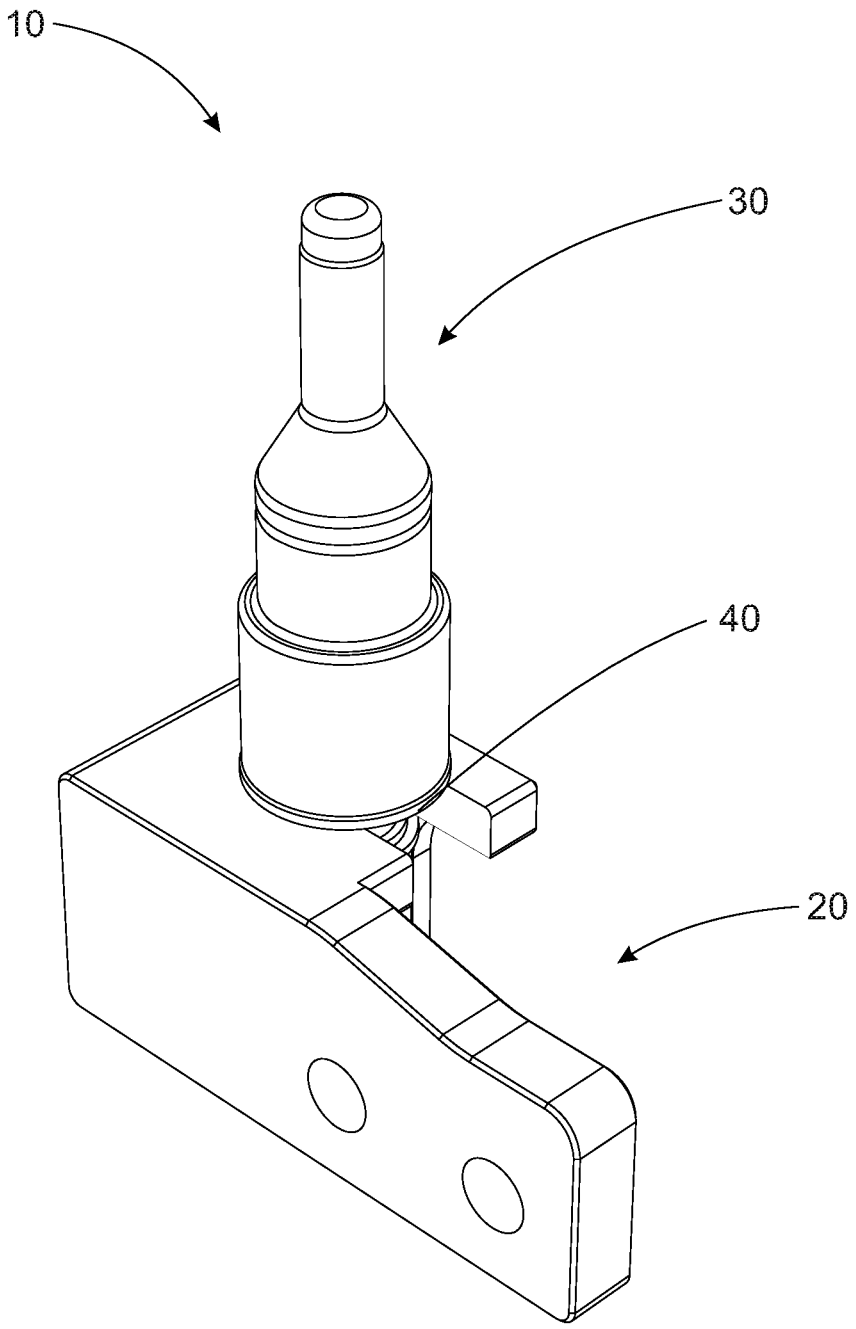
FIG. 1 is a perspective view of a primer pocket swager, in accordance with embodiments of the invention.
Figure 2:
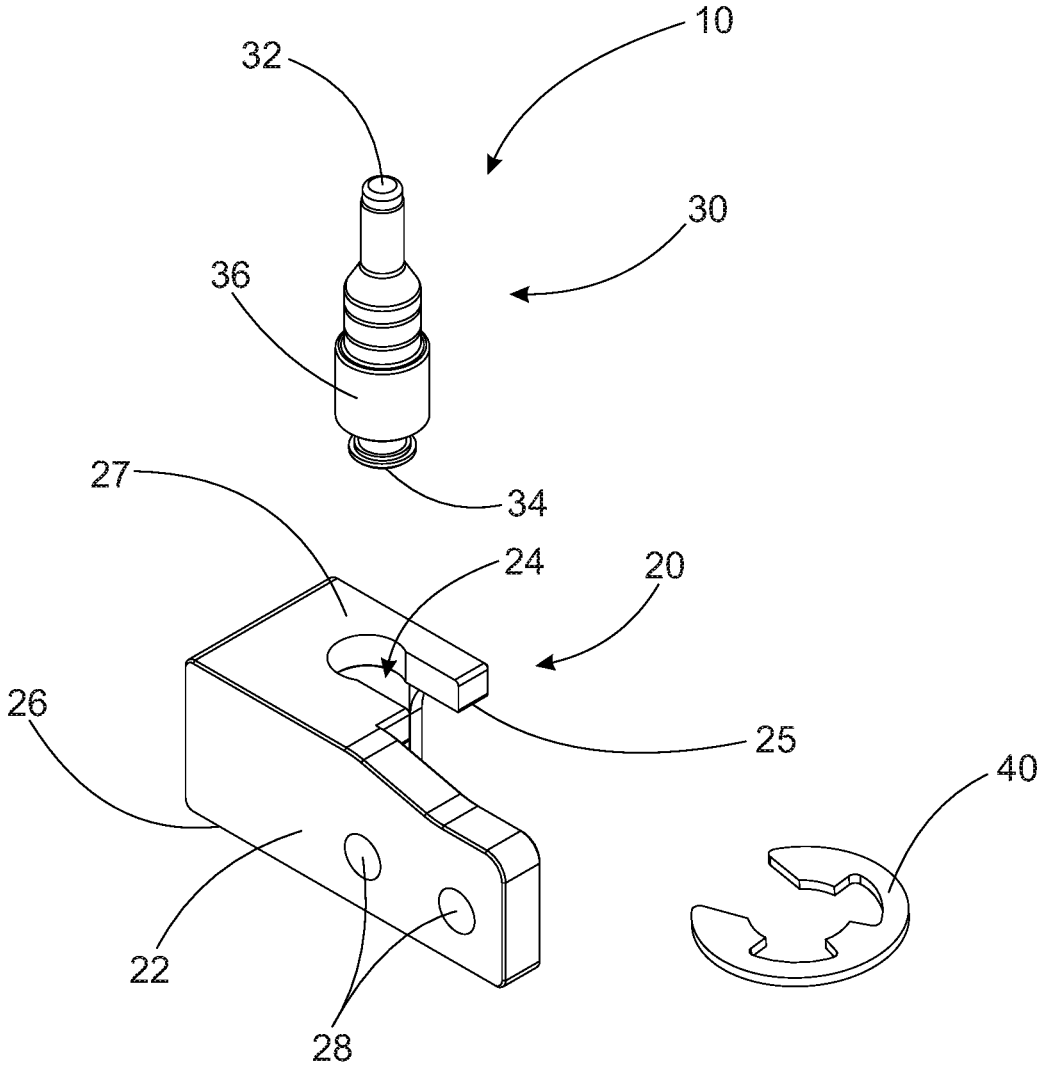
FIG. 2 is an exploded view of a primer pocket swager, in accordance with embodiments of the invention.
Figure 3:
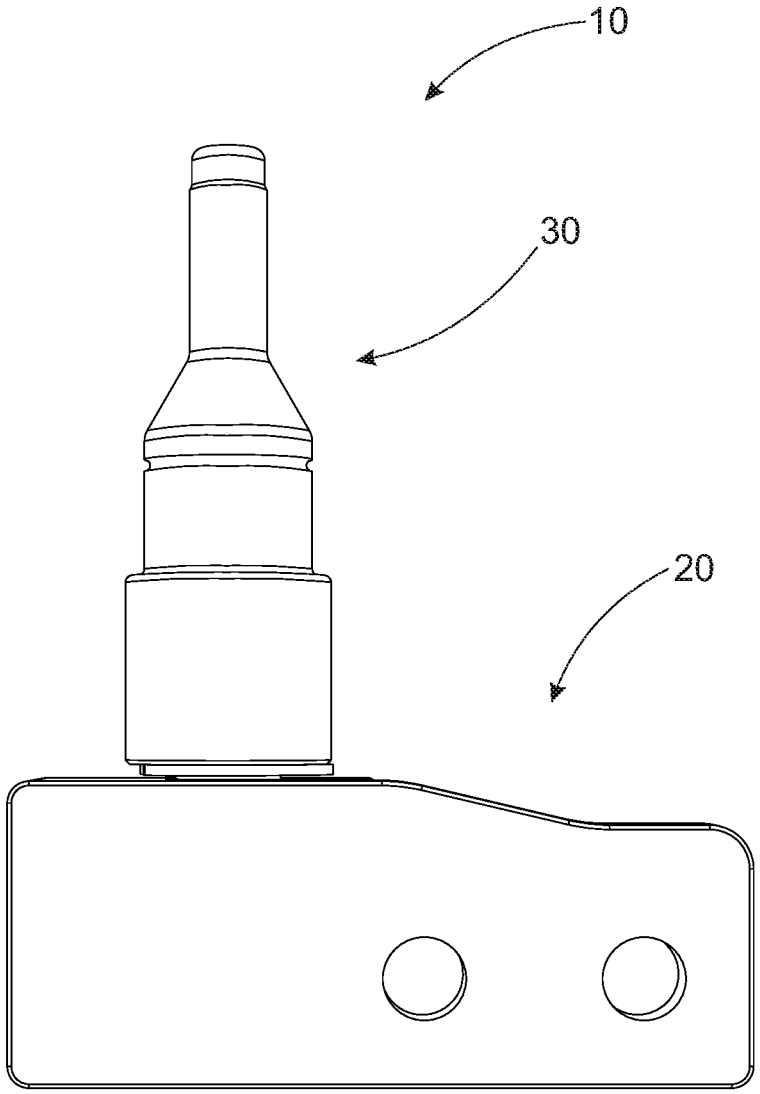
FIG. 3 is a side view of a primer pocket swager, in accordance with embodiments of the invention.
Figure 4:
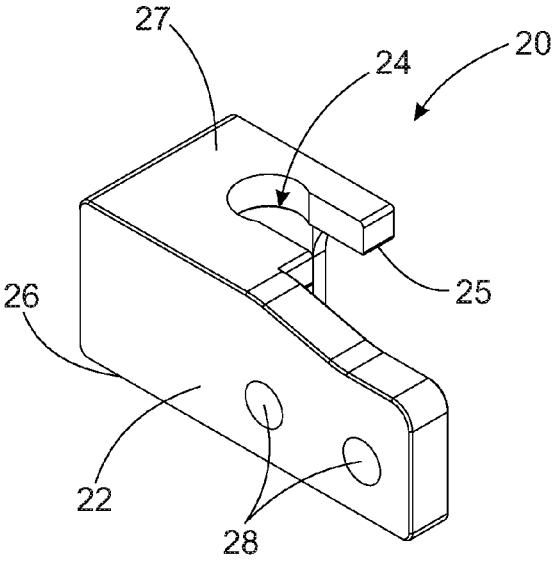
FIG. 4 is a perspective view of a base of a primer pocket swager, in accordance with embodiments of the invention.
Figure 5A:
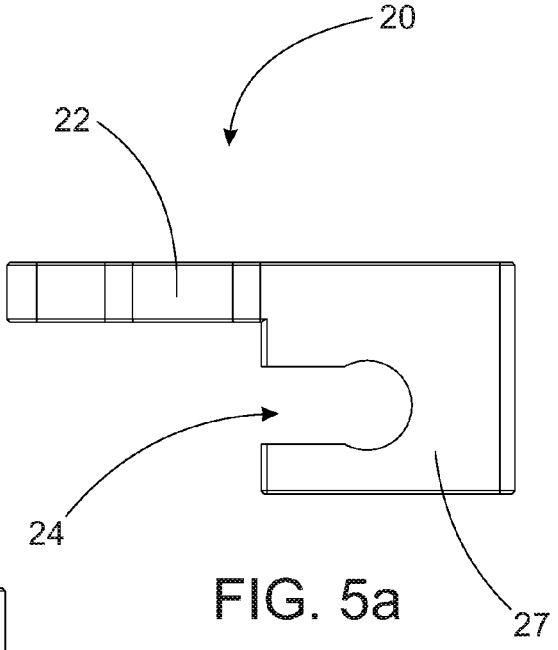
FIG. 5*a* is a top view of a base of a primer pocket swager, in accordance with embodiments of the invention.
Figure 5B:
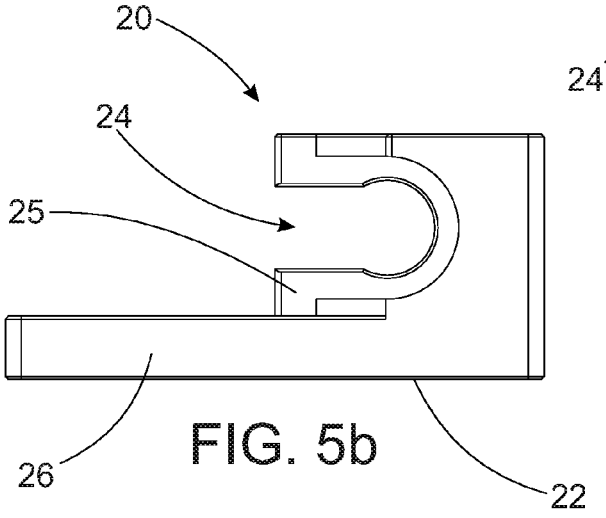
FIG. 5*b* is a bottom view of a base of a primer pocket swager, in accordance with embodiments of the invention.
Figure 6:
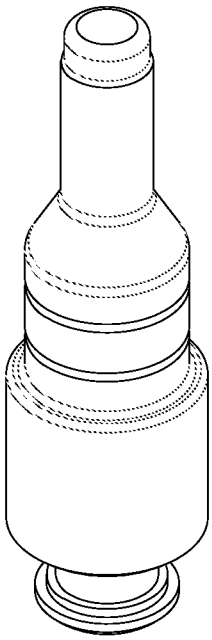
FIG. 6 is a perspective view of a first swage pin of a primer pocket swager, in accordance with embodiments of the invention.
Figure 7:
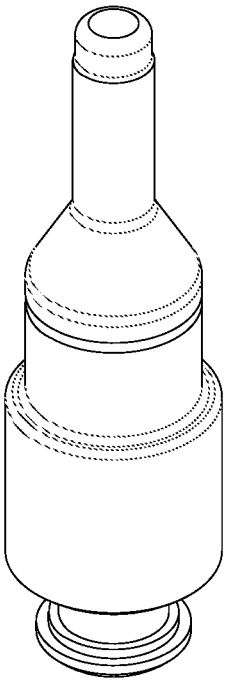
FIG. 7 is a perspective view of a second swage pin of a primer pocket swager, in accordance with embodiments of the invention.
Figure 8:
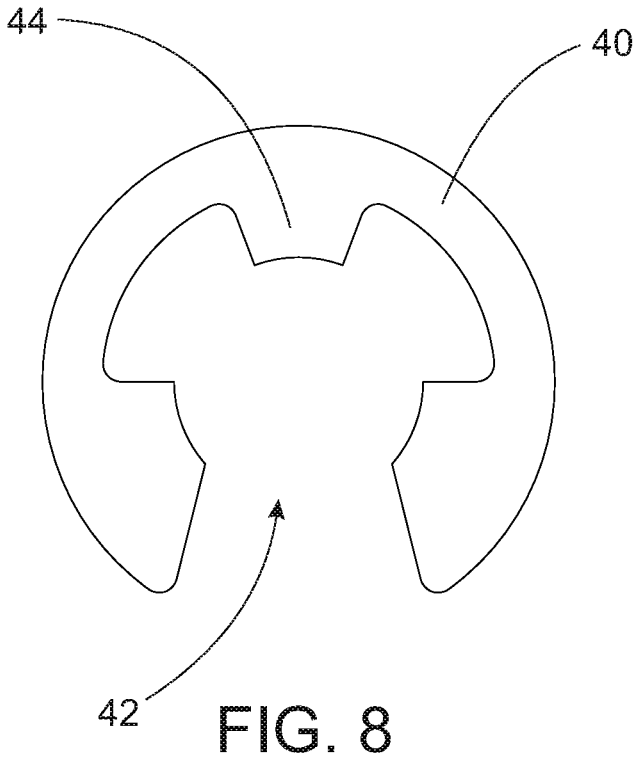
FIG. 8 is a top view of a lock clip of a primer pocket swager, in accordance with embodiments of the invention.
Figure 9:
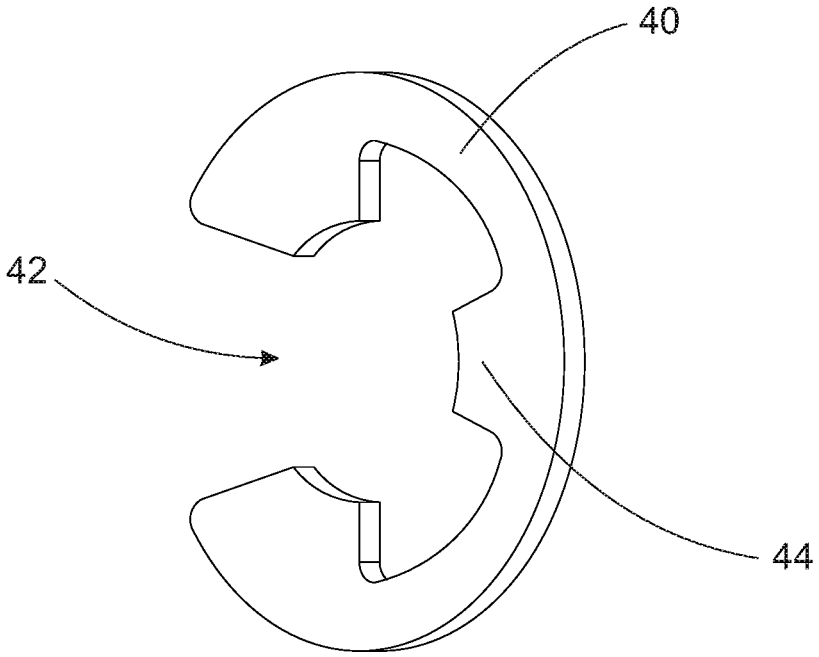
FIG. 9 is a perspective view of a lock clip of a primer pocket swager, in accordance with embodiments of the invention.
Figure 10:
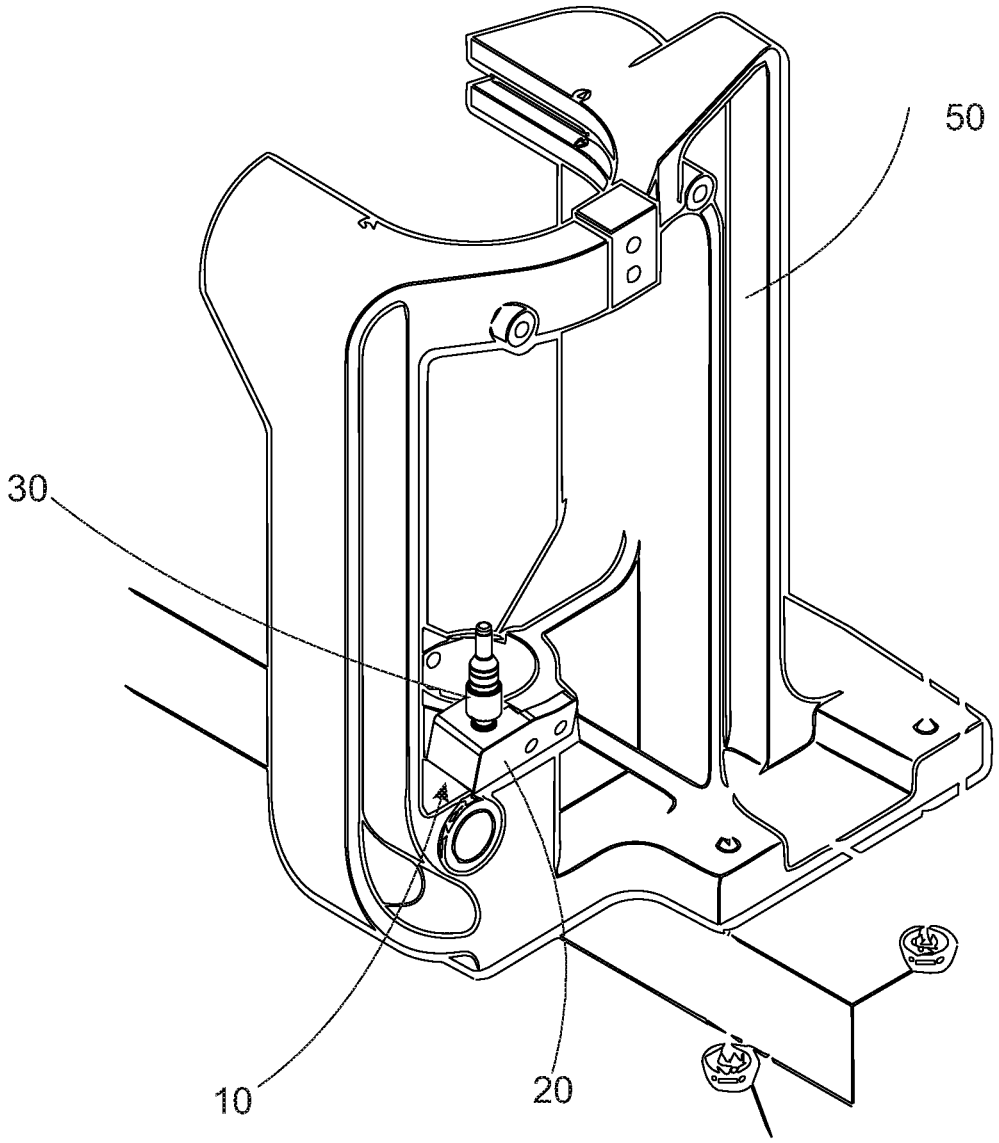
FIG. 10 is a perspective view of a primer pocket swager coupled to a press.

Referring to the drawings, FIGS. 1-10 depict a primer pocket swager 10 in accordance with embodiments of the present invention. The primer pocket swager 10 comprises a base 20 and swage pin 30. The base 20 comprises a mounting arm 22 having apertures 28 extending there through. The base 20 comprises a coupling mechanism 24 for coupling the swage pin 30 to the base 20. The base 20 further comprises a first support surface 25 and the second surface 26. When mounted to a reloading press, the first support surface 25 engages a first corresponding surface of the frame of the press and the second support surface 26 engage a second corresponding surface of the frame of the press. The first support surface 25 is located on a different and substantially parallel plane than the second support surface 26. During operation the support surface 25 and the support surface 26 operate to disperse the forces applied to the pocket primer swager throughout the base 20 and to the frame of the reloading press to avoid too much force applied in a single spot. This prolongs the life of the base 20 and the primer pocket swager 10.

The swage pin 30 comprises a primer engagement surface 32, a support body member 36 and coupling device 34. The coupling device 34 corresponds to the coupling mechanism 24. In some embodiments, coupling device 34 is a shaft corresponding to a slotted hole as the coupling mechanism 24. In these embodiments, a lock clip 40, such as an e-clip 40 may be used to lock the coupling device 34 of the swage pin 30 within the slotted hole 24 of the base. The lock clip 40 may be coupled to the coupling device 34 on a top side of the mounting plate 27. It is also understood that other devices and/or components may be used to couple the swage pin 30 to the base 20, such as but not limited to, a threaded connection, a friction fit connection, and the like.

The base 20 may be coupled to the frame of the press 50 by use of apertures 28 on the mounting arm 22. The mounting arm aligns the apertures 28 with the threaded holes in the frame of the press 50. Bolts may then be utilized to couple the base 20 to the frame of the press 50 through apertures 28.

In some embodiments, the swager 10 may be machined from billet aerospace stainless steel, the swager 10 may be heat treated/hardened to ensure longevity, the swager 10 will not rust like tool steel, the swager 10 is frame mounted for properly re-sizing primer pockets, the swaging pin 30 will never stick inside the primer pocket or hit the shell plate, and in some embodiments, there is no need to remove the rotary primer disk of the reloading press, which means that a user can swage in a matter of minutes without the need of time consuming disassembly of the primer system.

To install the primer pocket swager 10 to a press 50, such as the Dillon XL650, a user may 1) remove all primers; 2) remove the spent primer cup; 3) remove the primer seater assembly; 4) remove punch support bracket; 5) install the desired swage pin 30 onto the mounting plate 27 of the base 20, which may be accomplished by using the e-clip 40 installed on a top side of the mounting plate 27 of the base 20; 6) installing the primer pocket swager base 20 onto the press with screws; wherein the screws are not fully tightened; 7) lower the platform assembly of the press to ensure correct alignment of the primer pocket swager 20 with a shell plate of the press; and 8) tighten the exposed screw on the primer pocket swager base 20, raise the platform and tighten the second screw, and lower the platform to double check proper alignment.

While is has been discussed and shown that the swager 10 may be formed of billet aerospace stainless steel that has been heat treated/hardened, the components defining any swager may be formed of any of many different types of materials or combinations thereof that can readily be formed into shaped objects provided that the components selected are consistent with the intended operation of a swager. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any swager may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

An embodiment of the present invention may include a method of using a primer pocket swager. The method may generally include mounting a primer pocket swager to a frame of reloading press; placing a shell case onto a shell plate of the reloading press; operating the reloading press; and reforming a primer pocket of the shell case in response to operating the reloading press.

In some embodiments of the method, mounting the primer pocket swager to the reloading press comprises removing all primers, a spent primer cup, a primer seater assembly, and a punch support bracket from the reloading press. Mounting the primer pocket swager to the reloading press may also comprise coupling the primer pocket swager to the reloading press in a location of the punch support bracket of the reloading press. Further, mounting the primer pocket swager may comprise aligning a swage pin of the primer pocket swager with a shell plate of the reloading press.

In embodiments of the method, reforming the primer pocket of the shell case comprises extending the swage pin within the shell case in response to operating the reloading press. Additionally, in some embodiments, the reloading press is a Dillon XL650 reloading press.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A primer pocket swager comprising:

a base removably coupled to a reloading press; and a swage pin removably coupled to the base, the swage pin comprising a coupling device that is removably coupled to a coupling mechanism of the base, wherein the coupling device is a protrusion extending from a bottom end of the swage pin with a lip on a bottom end of the protrusion and the coupling mechanism comprises a slot formed in a mounting plate of the base, wherein:

the base comprises a first support surface and a second support surface;

the first support surface contacts a first corresponding surface of a frame of the reloading press;

the second support surface contacts a second corresponding surface of the frame of the reloading press; and the first support surface is located on a different and substantially parallel plane to the second support surface.

2. The swager of claim 1, wherein the base comprises a mounting arm having two apertures.

3. The swager of claim 2, further comprising two screws, wherein the two screws mount the base to a frame of the reloading press through the apertures of the mounting arm.

4. The swager of claim 2, wherein the mounting arm mounts the swager to the frame of the reloading press in a location of a punch support bracket of the reloading press.

5. The swager of claim 1, wherein the swage pin is coupled to the base by a sliding the protrusion into the slot of the mounting plate, wherein the bottom surface of the swage pin is adjacent a top surface of the mounting plate and the lip is adjacent a bottom surface of the mounting plate.

6. The swager of claim 5, further comprising a mounting clip, wherein the mounting clip releasably locks the swage pin to the base.

7. The swager of claim 6, wherein the mounting clip is coupled to the protrusion on a top surface of the mounting plate, wherein the mounting clip is coupled to the protrusion between the top surface of the mounting plate and a bottom surface of the swage pin.

8. The swager of claim 1, wherein the swage pin is aligned with a shell plate of the reloading press.

9. The swager of claim 1, wherein the reloading press is a Dillon XL650 reloading press.

10. A method of using a primer pocket swager, the method comprising:

mounting a primer pocket swager to a frame of a reloading press, wherein mounting the primer pocket swager to the frame of the reloading press comprises removing a primer seater assembly;

placing a shell case onto a shell plate of the reloading press;

operating the reloading press; and reforming a primer pocket of the shell case in response to operating the reloading press.

11. The method of claim 10, wherein mounting the primer pocket swager to the frame of the reloading press comprises removing all primers, a spent primer cup, and a punch support bracket from the reloading press.

12. The method of claim 11, wherein mounting the primer pocket swager to the reloading press comprises coupling the primer pocket swager to the reloading press in a location of the punch support bracket of the reloading press.

13. The method of claim 12, wherein mounting the primer pocket swager comprises aligning a swage pin of the primer pocket swager a shell plate of the reloading press.

14. The method of claim 13, wherein reforming the primer pocket of the shell case comprises extending the swage pin within the shell case in response to operating the reloading press.

15. The method of claim 10, wherein the reloading press is a Dillon XL650 reloading press.

* * * * *